US008312934B2

(12) United States Patent
Coronado

(10) Patent No.: US 8,312,934 B2
(45) Date of Patent: Nov. 20, 2012

(54) CONTROL LINE RETENTION AND METHOD FOR RETAINING CONTROL LINE

(75) Inventor: Martin P. Coronado, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 347 days.

(21) Appl. No.: 12/696,820

(22) Filed: Jan. 29, 2010

(65) Prior Publication Data

US 2010/0243272 A1 Sep. 30, 2010

Related U.S. Application Data

(60) Provisional application No. 61/163,325, filed on Mar. 25, 2009.

(51) Int. Cl.
*E21B 17/10* (2006.01)
*E21B 19/24* (2006.01)

(52) U.S. Cl. ..... 166/385; 166/241.6; 166/241.7; 166/242.3

(58) Field of Classification Search ..... 166/385, 166/241.6, 241.7, 242.3; 248/49, 68.1
See application file for complete search history.

(56) References Cited

U.S. PATENT DOCUMENTS

| | | | | |
|---|---|---|---|---|
| 4,483,395 | A * | 11/1984 | Kramer et al. | 166/241.6 |
| 6,789,621 | B2 * | 9/2004 | Wetzel et al. | 166/253.1 |
| 6,915,686 | B2 | 7/2005 | Baustad | |
| 7,100,690 | B2 | 9/2006 | Mullen et al. | |
| 7,131,494 | B2 | 11/2006 | Bixenman et al. | |
| 7,431,085 | B2 | 10/2008 | Coronado et al. | |
| 2004/0251386 | A1 * | 12/2004 | Mizukoshi et al. | 248/68.1 |
| 2006/0219404 | A1 * | 10/2006 | Coronado et al. | 166/278 |

FOREIGN PATENT DOCUMENTS

WO WO03027436 A1 4/2003

OTHER PUBLICATIONS

"PZM Sand Control System for Real-Time Payzone Production Monitoring," Baker Hughes, Jun. 23, 2001.

International Search Report and Written Opinion, Mailed Oct. 21, 2010, International Appln No. PCT/US2010/028471; International Search Report 7 pages; Written Opinion 4 pages.

* cited by examiner

*Primary Examiner* — Cathleen Hutchins
(74) *Attorney, Agent, or Firm* — Cantor Colburn LLP

(57) ABSTRACT

A line retention system includes a positionally fixed retainer having one or more recesses therein that are receptive to one or more lines. The system further includes one or more spline recesses in the positionally fixed retainer receptive to one or more position splines and one or more position splines that are receivable in the one or more spline recesses. A method for retaining one or more lines is included.

18 Claims, 12 Drawing Sheets

CONTROL LINE RETENTION AND METHOD FOR RETAINING CONTROL LINE

CROSS-REFERENCE TO RELATED APPLICATIONS

This application claims the benefit of an earlier filing date from U.S. Ser. No. 61/163,325 filed Mar. 25, 2009, the entire contents of which is incorporated herein by reference.

BACKGROUND

In order to run control lines downhole, the art has clamped the lines to outside of the screen shroud, and run an additional screen shroud outside of the multi-pathway tubes. This may be effective but does increase the overall outside dimension of the assembly. As one of skill in the art is all too aware, increasing an outside dimension or reducing an inside dimension are to be avoided.

SUMMARY

A line retention includes a positionally fixed retainer; one or more recesses in the positionally fixed retainer receptive to one or more lines; one or more spline recesses in the positionally fixed retainer receptive to one or more position splines; and one or more position splines receivable in the one or more spline recesses.

A method for retaining one or more lines on a downhole tubular system including fixedly attaching one or more position splines to the tubular system in locations to cause an after applied positionally fixed retainer to align recesses therein with a routing of the one or more lines; attaching one or more positionally fixed retainers including aligning one or more spline recesses of the one or more positionally fixed retainers with the one or more fixedly attached position spines; positioning one or more recesses of the one or more positionally fixed retainers over the one or more lines by virtue of the one or more positionally fixed retainers being positioned in accordance with the one or more position splines; and securing the one or more positionally fixed retainers.

A method for attaching a control line to a string including attaching at least one of a positionally fixed retainer and a clip to a string and protecting at least one control line therein.

BRIEF DESCRIPTION OF THE DRAWINGS

Referring now to the drawings wherein like elements are numbered alike in the several Figures:

Referring to FIG. 1, some of the components of a gravel packing apparatus 10 are illustrated to provide environment for the arrangement disclosed herein. In FIG. 1, a cross coupling connector 12 is illustrated twice with a space interval. The space interval is occupied primarily by a gravel pack screen. Such screens are known to the art and do not require explanation here. The screen itself is not shown in the Figures hereof but will be understood by one of ordinary skill in the art to be beneath the screen shroud (identified as 42 hereunder), which is represented in the Figures. Although the view includes only two connectors 12, it is to be understood that more (or only one) may be utilized in the gravel pack apparatus 10. Each connector 12 is illustrated with pass-through 14 for four multi-pathway tubes 16*a*. The tubes 16*a* proceed longitudinally and meet in a fluid conveyable manner with multi-pathway tubes 16*b*. Multi-pathway tubes 16*b* proceed helically along apparatus 10 until meeting in a fluid conveyable manner with multi-pathway tubes 16*c*. Multi-pathway tubes 16*c* proceed longitudinally into the next connector 12. It will be understood that tubes 16*a-c* are each considered a multi-pathway tube and are broken into parts merely to aid discussion. As noted, four multi-pathway tubes 16*a-c* are illustrated; it is to be understood that more or fewer can be utilized as desired.

At each connector 12, at least one of the multi-pathway tubes 16*a-c* will have ports (not shown but known to one of skill in the art and present in the commercially available "direct pak" screen from Baker Oil Tools, Houston, Tex.). Multi-pathway tubes adjacent those with ports will not have ports. A particular tube will have ports for about one-quarter of the total length of the screen component (see screen shroud 42) of the gravel pack apparatus 10. For example, a 1000-foot screen will have the ports change four times, once at each 250-foot increment of the 1000-foot screen. Each change will occur at a cross coupling connector 12. The fact that one of the tubes 16*a-c* will not have ports at each increment means that such tube may safely retain a control line 18 in an appurtenant projection (specifically identified hereunder). To maintain the control line in safety along the entirety of the screen section, the line may be moved back and forth between adjacent appurtenant projections at the end of each increment, with the change taking place at a connector 12. As is apparent from the foregoing, a desired location for the control line is along one of the tubes 16*b* that does not have ports. Utilizing this arrangement, a control line may be secured in a position that is not particularly exposed to the high velocity gravel slurry while also avoiding the need for any external clamps or extra shroud. Further, because of the ability of the control line to be shifted back and forth between adjacent tubes 16*a-c*, the control line may be kept away from the high velocity slurry over the entire extent of the screen section (see screen shroud 42) of apparatus 10.

Figure 1:
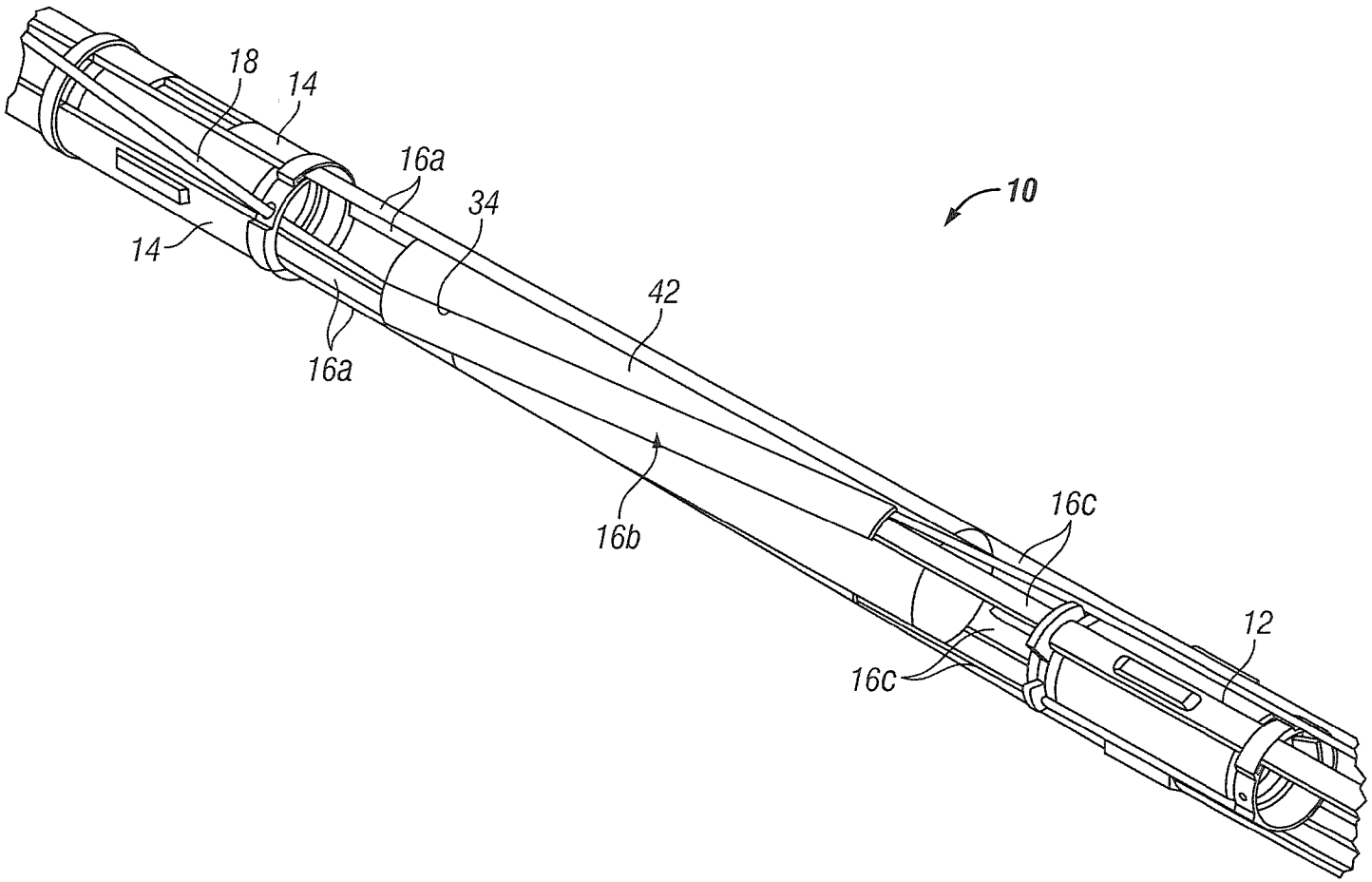
FIG. 1 is a perspective schematic view of a gravel pack component illustrating multi-pathway tubes and a control line.
Figure 2:
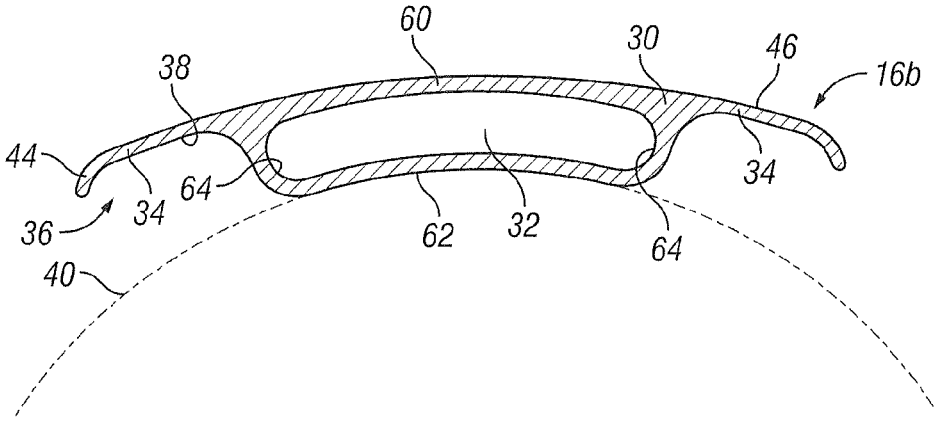
FIG. 2 is a cross-sectional view of the multi-pathway tube with a screen shroud shown in phantom.

Because of the arrangement noted, the inventors hereof determined that securement of the control line near a multi-pathway tube that did not include ports for each of the segments of the apparatus would be advantageous. Unfortunately, there was no known way to achieve this without resorting to external clamps, which suffer from the drawbacks noted above. Referring to FIG. 2, a cross-section view of a multi-pathway tube 16*b* according to the teaching herein is illustrated. Tube 16*b* includes a body 30 defining a flow passage 32, the body having a radially larger boundary 60 and a radially smaller boundary 62, the boundaries joined laterally by semicircular boundaries 64. Further, appurtenant the body 30 is at least one, and as illustrated two, wing-shaped projections 34. Each projection 34 extends from body 30, at a substantially equivalent radius of curvature to the radially larger boundary 60, at a lateral edge thereof and extends for a length sufficient to receive a control line (not shown). Each projection forms a pocket 36 between a concave surface 38 thereof and an outer surface 40 (shown in phantom) of screen shroud 42 (see FIG. 1). Advantageously, projection 34 includes a lip 44 at an end thereof remote from body 30. Lip 44 is useful for enhancing retention of control line 18 once inserted at projection 34. Further, lip 44 causes an outside surface 46 of projection 34 to present a convex configuration, which is helpful with respect to avoiding hang-ups during the running of the apparatus 10.

As noted above, tube 16*b* is helically arranged about shroud 42, which additionally assists in maintaining the control line 18 against the shroud 42.

Figure 3:
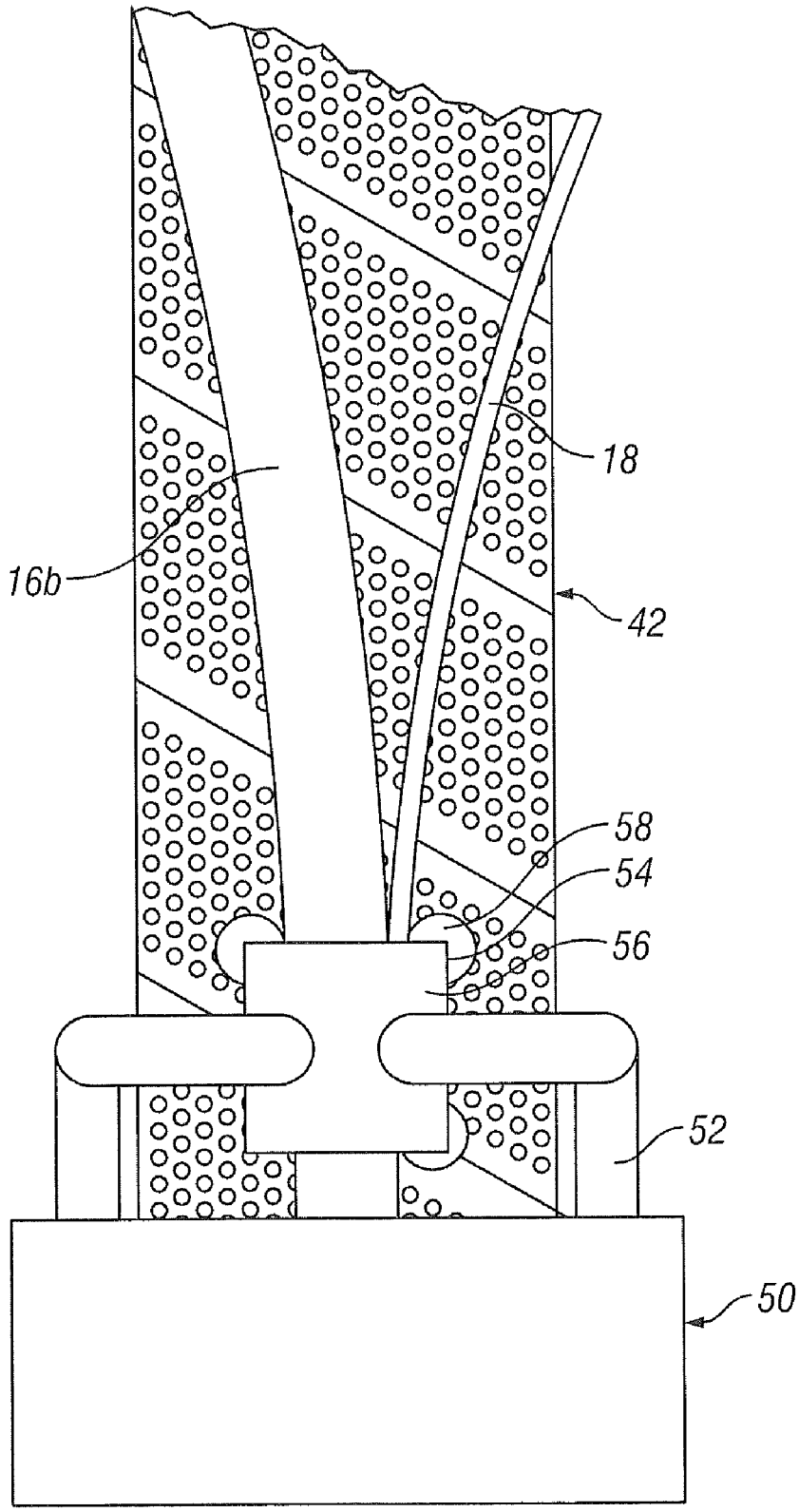
FIG. 3 is a schematic elevation view of the component illustrated in FIG. 1 entering a rotary and the control line being inserted.
Figure 4:
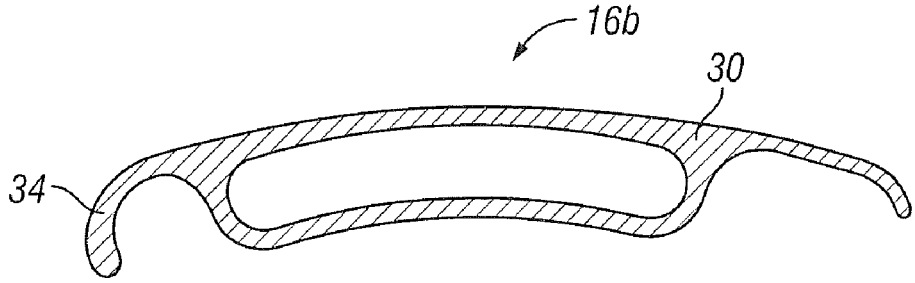
FIG. 4 is a view similar to FIG. 2 but with one of the projections bent.

Referring to FIG. 3, a schematic representation depicting shroud 42, tube 16*b*, control line 18 and an insertion device is provided. A rotary table 50 is known to the art and requires no explanation. Extending from a portion of the table 50 is a support 52 upon which is mounted a cable snap machine 54. The cable snap machine 54 is here illustrated to comprise a body 56 and four rolling or non-rolling bushings 58. It is to be understood that more or fewer bushings could be utilized and that bearings could be substituted without departing from the scope of the disclosure hereof. The bushings 58 that are horizontally (in the Figure) spaced from each other are a fixed distance apart, that distance calculated to support the tube 16*b* at one side and urge the control line 18 under the projection 34 on the other side of the same tube 16*b*. Movement of the shroud (and the rest of the apparatus 10) in a downward direction (relative to the Figure) automatically causes the control line to engage the projection 34. The second pair of bushings illustrated lower in the Figure either further engage the control line with the projection or merely ensure that it engaged appropriately when passing through the first set of bushings. Additionally, in one embodiment, if one of the wing-shaped projections 34 at the multi-pathway tube does not contain a control line, the snap machine may be configured to deform the unsupported projection inwards toward the screen shroud 42 to reduce the possibility of the unsupported projection 34 coming in contact with any restrictions in the wellbore, which may potentially damage the flow area section of the tube. Such a condition is illustrated in FIG. 4. The deforming of the projection can be accomplished simultaneously while the control line is being snapped into the other side of the tube or can be accomplished without regard for whether or not a control line is present on the other side of the tube 16*b*.

Figure 5:
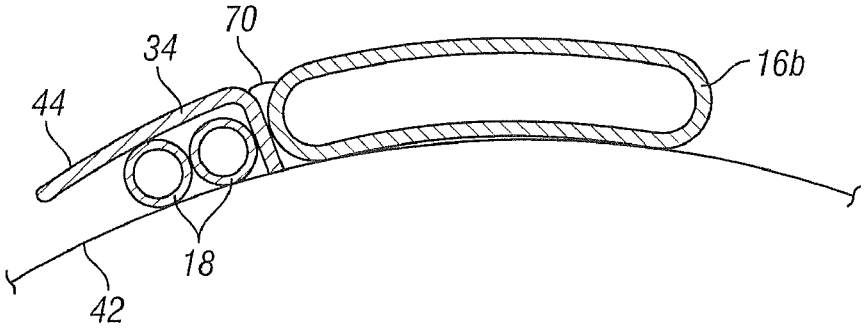
FIG. 5 is a schematic representation of an alternative multi-pathway tube.
Figure 6:
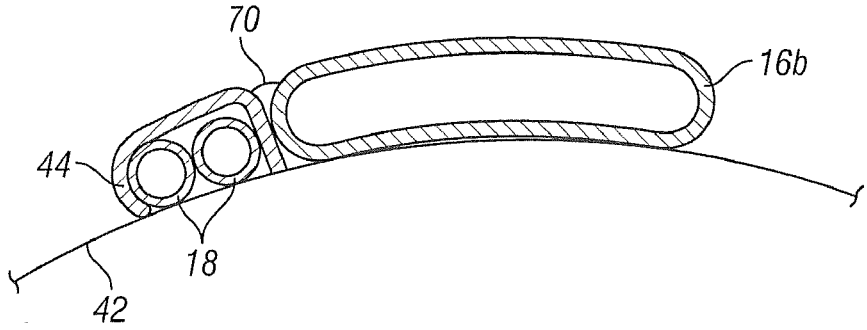
FIG. 6 is a schematic representation of the alternative multi-pathway tube of FIG. 5 in a completed condition.

In yet another embodiment, referring to FIGS. 5 and 6, the projection 34 (here illustrated to be welded at weld bead 70 onto the multi-pathway tube 16*b*) is deformed over an inserted control line by bending lip 44 toward the shroud 42 to more permanently and encapsulatively engage the control line. The lip is illustrated in the undeformed condition in FIG. 5 and in the deformed condition in FIG. 6. The snap in machine is easily modifiable to accomplish the deforming of the projection to encapsulate the control lines against the shroud 42 by substituting a differently shaped bushing or bearing having a concave shape to form the lip 44.

Earlier in this disclosure, it was stated that the control line is maintained in a protected position relative to ports in the multi-pathway tubes 16*b*. When inserting the control line into the tube 16*b*, and after a one-quarter length of the total gravel screen is reached the control line is manually moved over to position it to be engaged by an adjacent tube 16*b*. The process of inserting the control line 18 then continues as described hereinabove. One of skill in the art should appreciate that when the line 18 is moved over to an adjacent tube 16*b*, the line will be on a physically opposite side of the machine 54. In an embodiment where each side of machine 54 is a mirror image, no adjustment will be necessary but only a reengagement with the control line need be performed. Alternatively, and where one of the described embodiments that causes deformation is utilized, the machine 54 will be adjusted to reverse the action of the machine such as by reversing the bushings 58.

In accordance with the concepts and apparatus disclosed herein, control lines hereby can be added to the apparatus 10 right on the rig floor and while the apparatus is being run in the hole. Resultantly, the control line is protected and maintained in position. It is to be understood that "control line" or "line" as used herein means control and or sensory lines and is intended to include single or multiple hydraulic, electrical, fiber optic lines, etc. and that the lines may be individual in form, nested, flat packed, etc.

Figure 7:
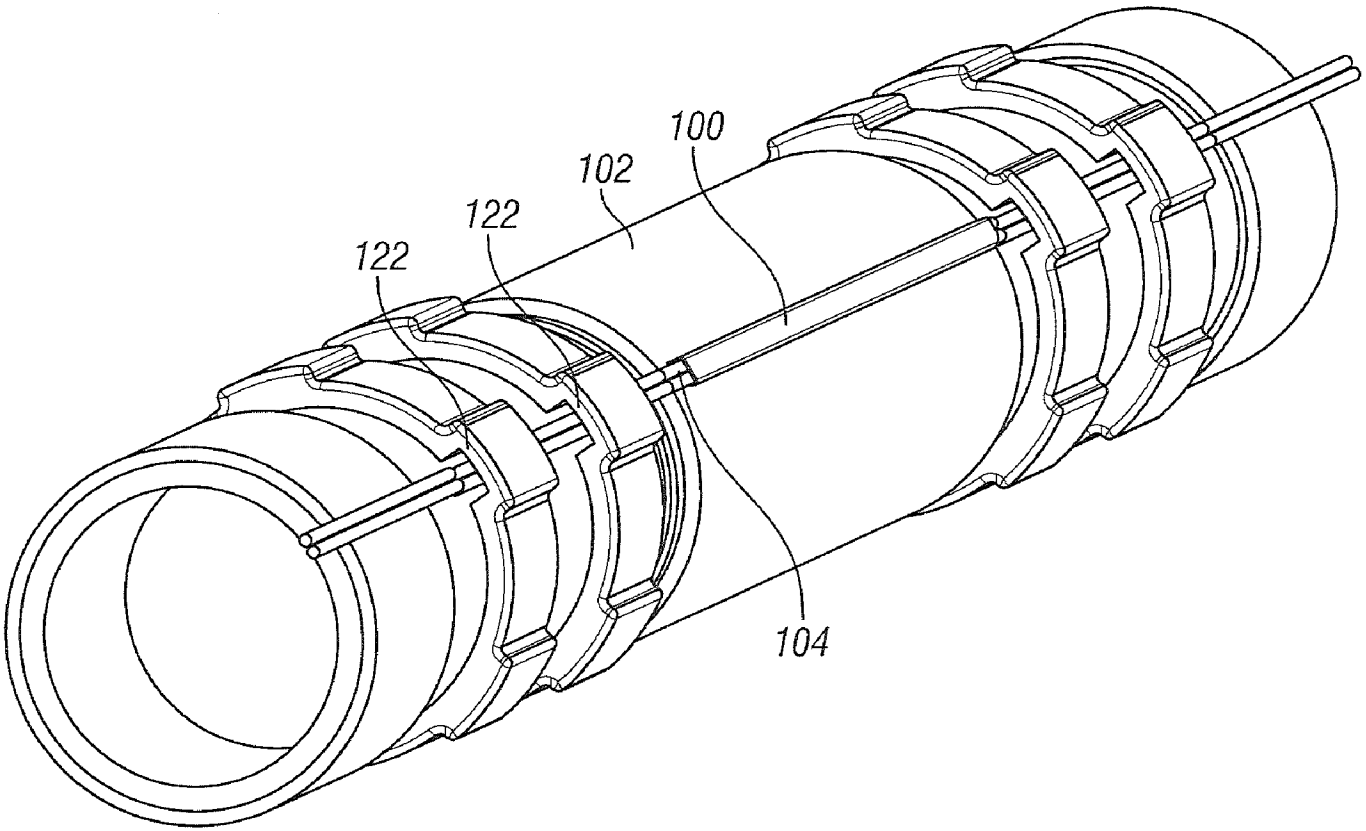
FIG. 7 is a perspective view of an alternate embodiment featuring a clip and a series of positionally fixed retainers.
Figure 8:
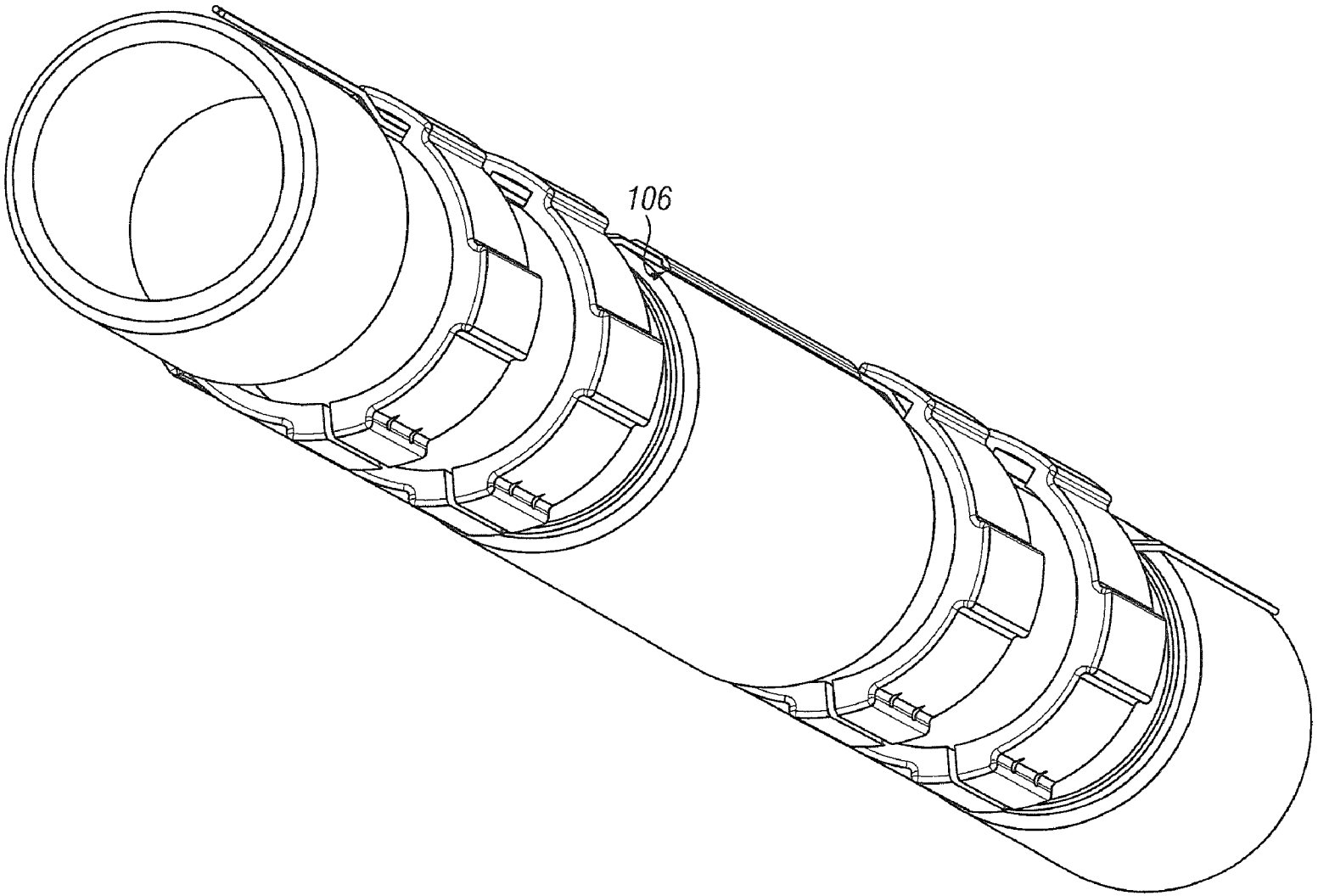
FIG. 8 is a perspective view of the embodiment of FIG. 7 in a different orientation to show an opening of the clip.
Figure 9:
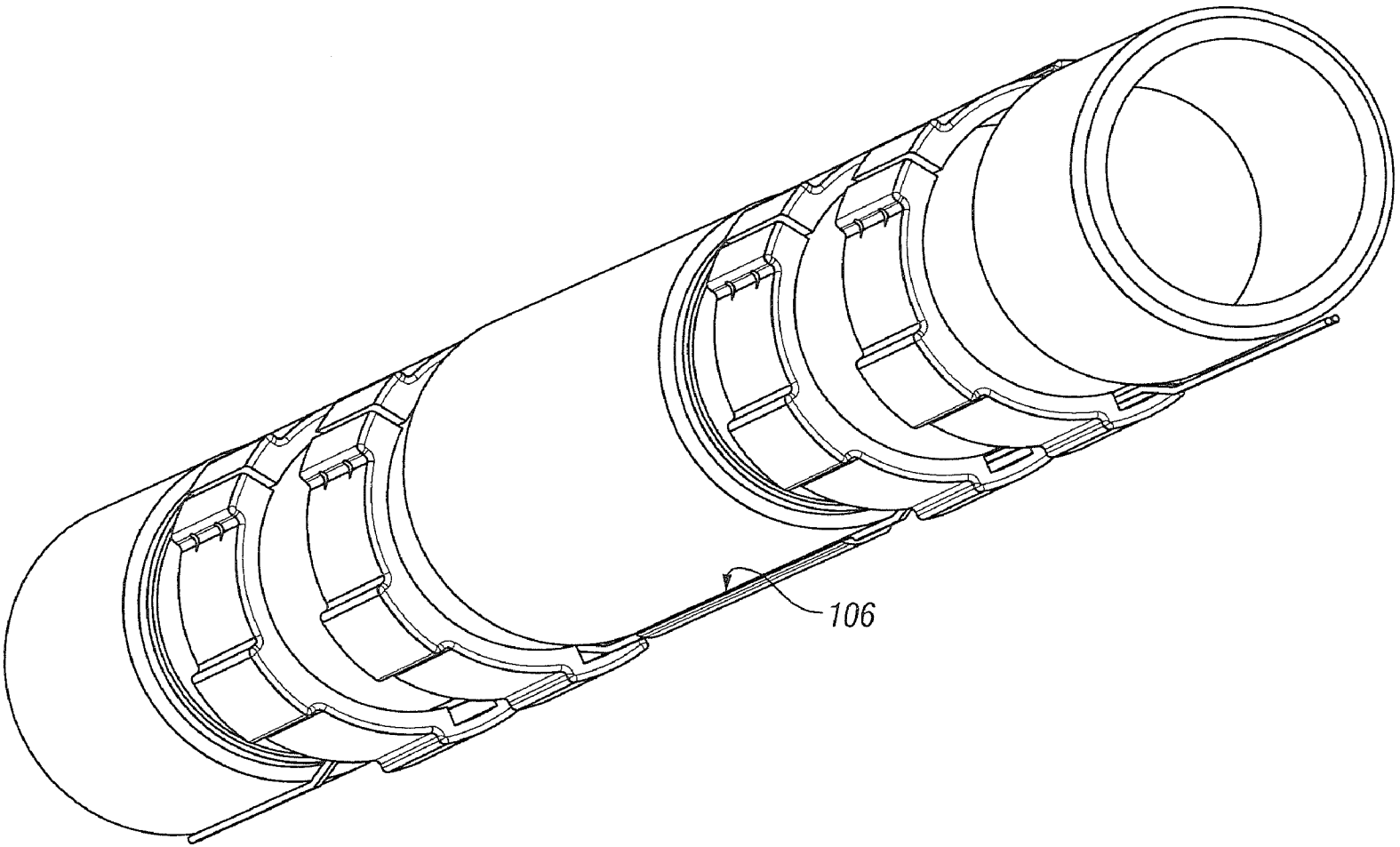
FIG. 9 is a perspective view similar to FIG. 8 but slightly rotated.
Figure 10:
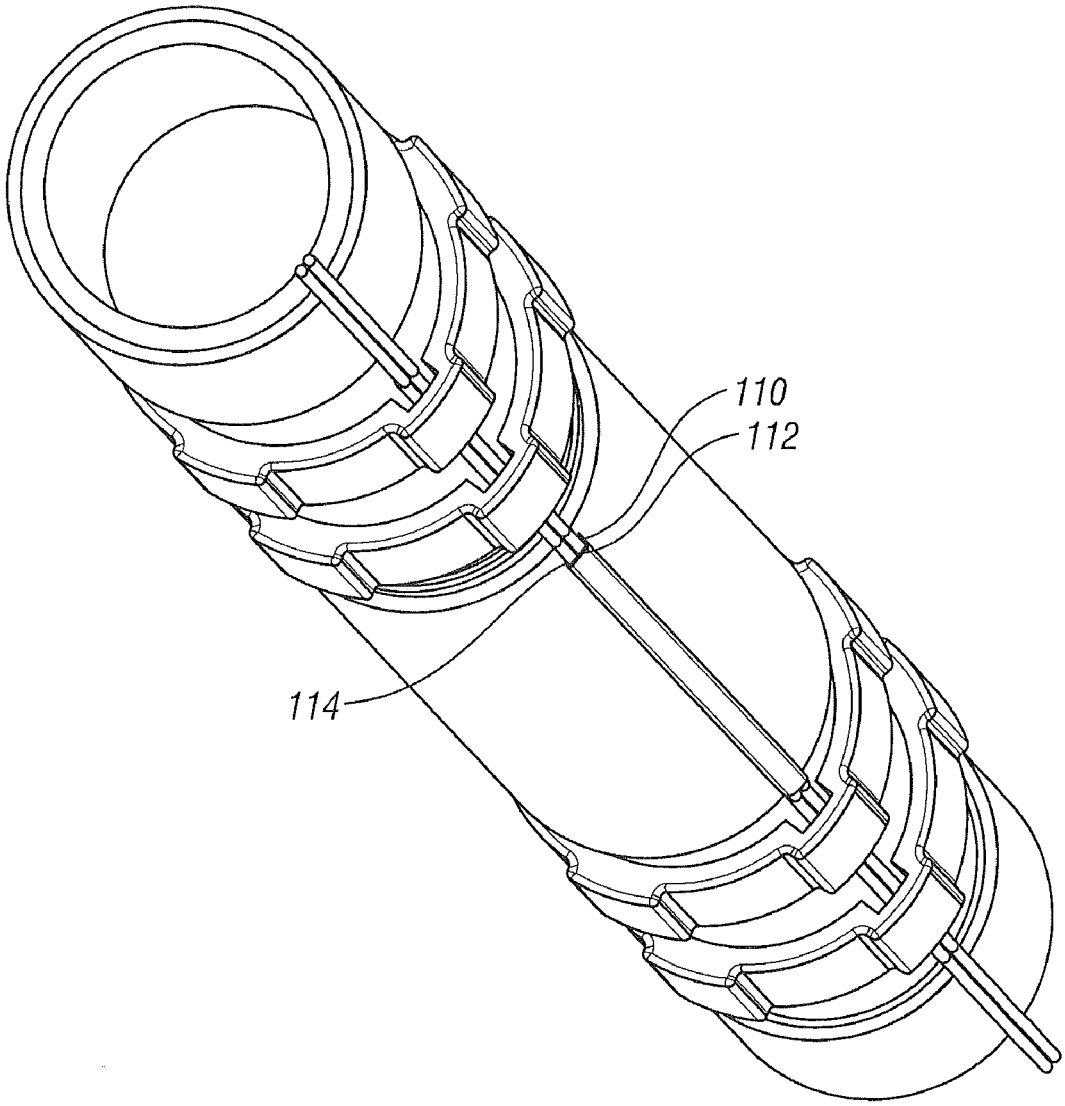
FIG. 10 is a perspective view of the embodiment of FIG. 7 in an orientation showing the control lines running through the positionally fixed retainers and showing the shape of the clip.

In another embodiment of the line retention concept disclosed herein, and referring to FIGS. 7-13, a clip 100 is shown spanning a screen 102 covering line(s) 104. The clip 100 may be attached to the screen or any other radially outermost structure by mechanical means or welding and may be permanent or removable providing that the attachment has sufficient strength to protect the line(s) 104 while crossing the screen 102. It is to be appreciated that the clip must be positioned on a radially outermost layer so that access to the clip is available while running in the hole as the lines 104 are fed into the clip as the string is run into the hole. FIGS. 8 and 9 show a gap 106 through which the line(s) 104 are inserted while the string is being run. And although the intent is to enable insertion of the lines 104 while running, it is also possible that the lines may be inserted while the string is at rest. FIG. 10 best shows the shape of the clip 100 to have an attachment leg 110, an overfeature 112 and a retention lip 114. The attachment leg 110 may be welded to the screen or otherwise mechanically attached thereto. The overfeature 112 provides protection to the line(s) 104 from lateral impact and the lip 114 helps ensure the line(s) 104 stay retained in the clip. Spacing between the lip 114 and the screen 102 is to be slightly smaller than an outside dimension of the line(s) 104 so that a snap fit arrangement is created as the line(s) 104 are pushed into the clip this property being facilitated by clip resilience. The clip 100 will in one embodiment run the length of the screen and may be in a single length of material or multiple lengths arranged adjacently to run the length of the screen or may be arranged in spaced manner, with various selected spacings for particular applications.

Figure 11:
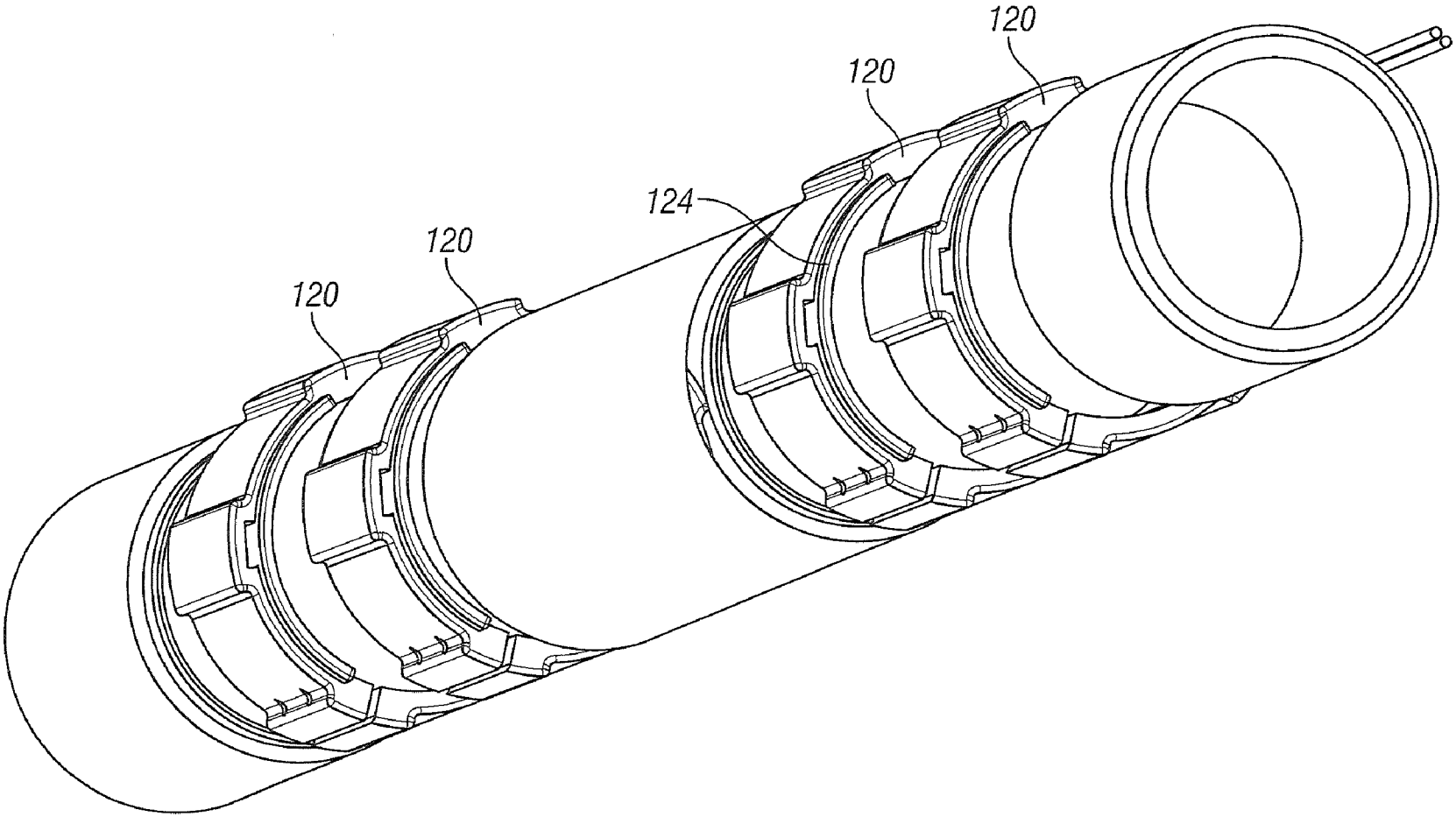
FIG. 11 is a perspective view of the embodiment of FIG. 7 showing the positionally fixed retainers engaged with features to prevent axial and rotational movement thereof.
Figure 12:
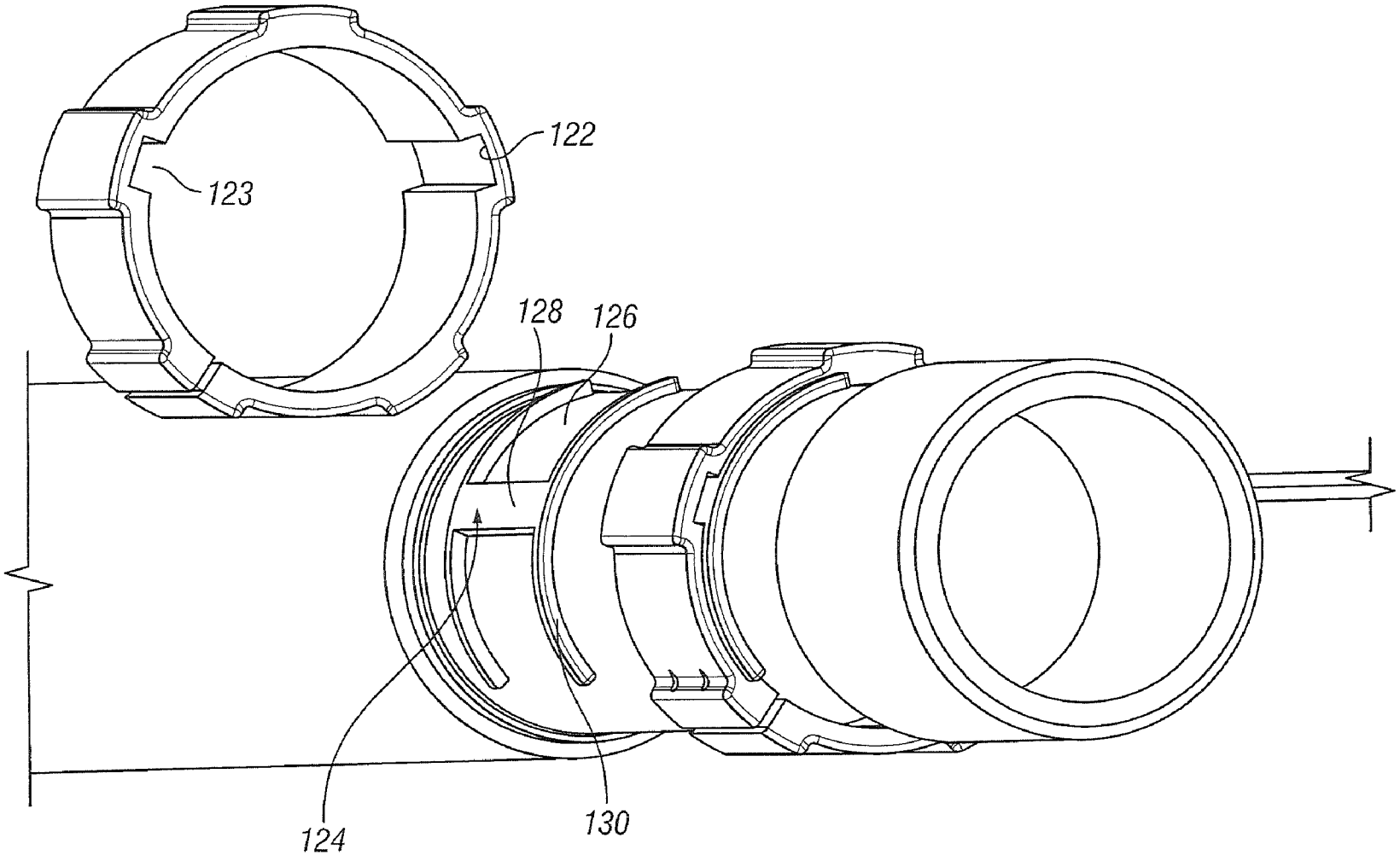
FIG. 12 is the view of FIG. 11 but with a positionally fixed retainer removed to enhance understanding of the anti rotation and or anti axial movement feature.
Figure 13:
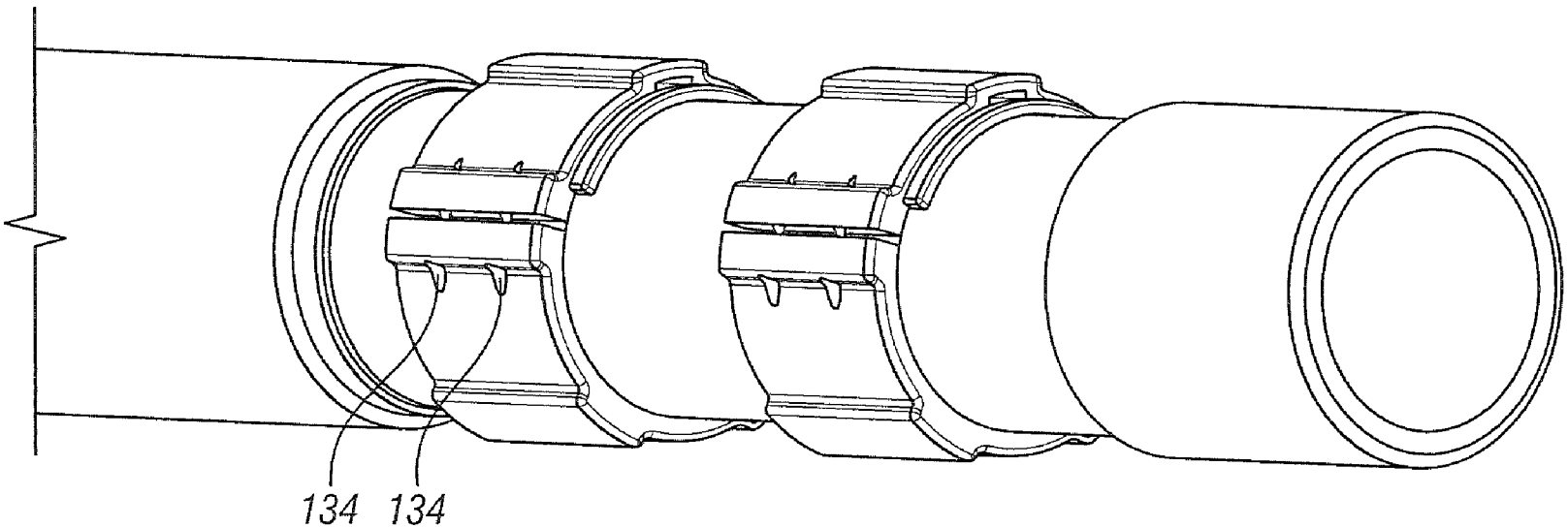
FIG. 13 is a perspective view of the embodiment of FIG. 7 showing the bolted configuration of the positionally fixed retainers.

Turning to FIGS. 11-12, one or more positionally fixed retainers 120 (rotationally or rotationally/axially fixed), which in the illustrated embodiment are also centralizer(s), may be used with other components disclosed hereinabove or used alone as a line retention system. It is possible to include one or more of the positionally fixed retainers 120 in a particular embodiment. Four are shown in the illustration but this should not be perceived as limiting. The positionally fixed retainers 120 each include one or more line recesses 122, one of which is illustrated in FIG. 7, and one or more spline recesses 123 (one illustrated). Further a position spline 124 is visible in FIGS. 11 and 12 that is received in the spline recess 123 when a positionally fixed retainer 120 is in an installed position. The position spline 124, one for each positionally fixed retainer, is fixedly attached to a mandrel 126. The splines 124 each include a web 128 and at least one flange 130, and as shown, two flanges 130. The purpose of the spline is to prevent rotational movement and axial movement of each positionally fixed retainer 120. Splines 124 could be modified to prevent only one of these movements if desired. The web 128 will be positioned some number of degrees away from the line recess 122 to help ensure that the positionally fixed retainer goes onto the string in only one way to prevent error in assembly. The positionally fixed retainer itself may be constructed of any strong yet flexible material to facilitate opening thereof to dispose the positionally fixed retainer about the mandrel 126 while running. In one embodiment, the positionally fixed retainer comprises hard rubber. In order to ensure that the positionally fixed retainer(s) 120 cannot fall off the mandrel, referring to FIG. 13, the positionally fixed retainers are individually bolted in place through bolt holes 134.

While preferred embodiments have been shown and described, modifications and substitutions may be made thereto without departing from the spirit and scope of the invention. Accordingly, it is to be understood that the present invention has been described by way of illustrations and not limitation.

The invention claimed is:

1. A line retention system comprising:

a tubular;

a positionally fixed retainer;

one or more recesses in the positionally fixed retainer receptive to one or more lines;

one or more spline recesses in the positionally fixed retainer; and one or more position splines receivable in the one or more spline recesses and attached to the tubular, wherein the positionally fixed retainer is openable about the tubular for enabling the one or more position recesses to be positioned with respect to the one or more spline recesses while receiving the one or more position splines in the one or more spline recesses.

2. A line retention system as claimed in claim 1 wherein the positionally fixed retainer comprises a hard rubber.

3. A line retention system as claimed in claim 1 wherein each of the one or more recesses is receptive to one or more lines.

4. A line retention system as claimed in claim 1 wherein the one or more position splines limit movement of the positionally fixed retainer rotationally.

5. A line retention system as claimed in claim 1 wherein the one or more position splines limit movement of the positionally fixed retainer in one axial direction.

6. A line retention system as claimed in claim 1 wherein the one or more position splines limit movement of the positionally fixed retainer in two axial directions.

7. A line retention system as claimed in claim 1 wherein the one or more position splines limit movement of the positionally fixed retainer in two axial directions and rotationally.

8. A line retention system as claimed in claim 1 wherein the system further comprises a clip that extends axially from a position in proximity to the positionally fixed retainer along a screen adjacent thereto.

9. A line retention system as claimed in claim 8 wherein the clip extends over an entire length of the screen.

10. A line retention system as claimed in claim 8 wherein the clip extends over one or more portions of the screen.

11. A line retention system as claimed in claim 8 wherein the clip comprises an attachment leg;

an overfeature attached to the attachment leg; and a lip extending from the overfeature.

12. A line retention system as claimed in claim 11 wherein the attachment leg is fixedly attached to the screen.

13. A line retention system as claimed in claim 11 wherein the lip defines an opening between the lip and the screen that is slightly smaller than one or more lines to be protected by the clip to provide a snap fit for the one or more lines.

14. A line retention system as claimed in claim 1 wherein the one or more recesses and one or more spline recesses are positioned within the positionally fixed retainer to discourage incorrect alignment during assembly.

15. A line retention system as claimed in claim 1 wherein the positionally fixed retainer includes a centralizer.

16. A method for retaining one or more lines on a downhole tubular system comprising:

fixedly attaching one or more position splines to a tubular of the tubular system in locations to cause an after applied positionally fixed retainer to align recesses therein with a routing of the one or more lines;

attaching one or more positionally fixed retainers including aligning one or more spline recesses of the one or more positionally fixed retainers with the one or more fixedly attached position spines;

opening the positionally fixed retainer about the tubular for enabling the one or more spline recesses to be positioned with respect to the one or more fixedly attached position splines;

positioning one or more recesses of the one or more positionally fixed retainers over the one or more lines by virtue of the one or more positionally fixed retainers being positioned in accordance with the one or more position splines; and securing the one or more positionally fixed retainers.

17. A method for retaining one or more lines on a downhole tubular system as claimed in claim 16 further comprising urging the one or more lines under a clip adjacent to one or more of the one or more positionally fixed retainer.

18. A method for attaching a control line to a string including attaching at least one of a positionally fixed retainer and a clip to a string and protecting at least one control line therein.

* * * * *